US008646468B2

(12) United States Patent
Pires et al.

(10) Patent No.: US 8,646,468 B2
(45) Date of Patent: Feb. 11, 2014

(54) COSMETIC CONTAINER

(75) Inventors: Leo Clifford Pires, Basking Ridge, NJ (US); Roger Hwang, Maple (CA); Iti Seth, New Delhi (IN); Rahul Bose, New Delhi (IN); Koushik Kohli, Uttar Pradesh (IN); Santosh Mohapatra, New Delhi (IN)

(73) Assignee: Zen Design Solutions Limited, Hong Kong (HK)

( * ) Notice: Subject to any disclaimer, the term of this patent is extended or adjusted under 35 U.S.C. 154(b) by 293 days.

(21) Appl. No.: 12/689,024

(22) Filed: Jan. 18, 2010

(65) Prior Publication Data

US 2010/0111590 A1 May 6, 2010

Related U.S. Application Data

(63) Continuation-in-part of application No. 11/518,817, filed on Sep. 11, 2006, now Pat. No. 7,673,636.

(51) Int. Cl.
*A45D 33/02* (2006.01)

(52) U.S. Cl.
USPC ..... 132/307

(58) Field of Classification Search
USPC ..... 132/307, 317, 313, 297, 293, 306, 218, 132/320, 298; 401/195, 122–129, 116; 206/229, 581, 209, 361, 385, 235
See application file for complete search history.

(56) References Cited

U.S. PATENT DOCUMENTS

| | | | | | |
|---|---|---|---|---|---|
| 3,908,675 | A * | 9/1975 | Spatz et al. | ..... | 132/293 |
| 4,545,393 | A * | 10/1985 | Gueret et al. | ..... | 132/218 |
| 5,121,763 | A * | 6/1992 | Kingsford | ..... | 132/317 |
| 5,137,038 | A * | 8/1992 | Kingsford | ..... | 132/218 |
| 6,474,346 | B1 | 11/2002 | Jang | | |
| 6,588,959 | B1 * | 7/2003 | Kuo | ..... | 401/108 |
| 6,764,239 | B2 | 7/2004 | Kim | | |
| 6,799,582 | B2 | 10/2004 | Kim | | |
| 6,883,990 | B2 * | 4/2005 | Shih | ..... | 401/127 |
| 2002/0076257 | A1 * | 6/2002 | Nadel | ..... | 401/195 |
| 2002/0162568 | A1 * | 11/2002 | Jang | ..... | 132/307 |
| 2005/0163554 | A1 * | 7/2005 | Cara Sanchez | ..... | 401/69 |
| 2008/0060674 | A1 | 3/2008 | Pires et al. | | |
| 2008/0092916 | A1 | 4/2008 | Song | | |

* cited by examiner

*Primary Examiner* — Todd Manahan
*Assistant Examiner* — Brianne Kalach
(74) *Attorney, Agent, or Firm* — Patterson & Sheridan, LLP

(57) ABSTRACT

The present invention generally is a container for storing cosmetic or care products. More particularly, the invention relates to a cosmetic container comprising a receptacle and a cover wherein the cover comprises an integrated applicator wherein the applicator is retractable within the cover. There is provided a cosmetic container comprising a receptacle, said receptacle comprising a housing for storing a product; a cover, said cover comprising a housing that accommodates an applicator and a protrusion retraction mechanism assembly for operating the applicator such that the applicator is integrated within the cover; and an actuating means for actuating the operation of the protrusion retraction mechanism assembly.

12 Claims, 14 Drawing Sheets

COSMETIC CONTAINER

CROSS-REFERENCE TO RELATED APPLICATION

This application is a continuation-in-part of U.S. patent application Ser. No. 11/518,817 filed Sep. 11, 2006 now U.S. Pat. No. 7,673,636, which is incorporated by reference in its entirety.

BACKGROUND

1. Field of the Invention

Embodiments of the present invention described herein generally relate to cosmetic containers, and in particular, relate to a container comprising a receptacle and a cover wherein the cover has an integrated applicator and wherein the applicator is retractable within the cover.

2. Description of the Related Art

Powder is a solid substance in the form of tiny loose particles. Powder that is used for application on the human body, especially the face, is known as cosmetic powder.

Cosmetic powder is mainly available in two forms—compressed or compact, and loose. Compressed cosmetic powder has a consistent solid cake form and it is usually packaged in flat-shaped compact cases. Typically, the case also includes a puff or a brush to help a user to apply the powder. A puff is a soft applicator device made from fluffy or deformable fibers. Whereas, a brush is an applicator device with a tuft of hair or bristles that is firmly attached to a holder. The puff or brush is rubbed over the compact powder surface to loosen some surface powder. The loosened powder sticks to the applicator device, which is then applied to the face.

However, loose powder as the name suggests, is loose and therefore it must be specially contained to avoid its spilling. Conventionally, loose powder is contained in a dispenser with a multiplicity of perforations on one end of the dispenser. A cap is provided to seal the perforations and to prevent spilling of the powder. For application, the cap is removed and the powder is shaken out of the perforations directly onto a puff, or into a dish from which it is picked up by a puff or a brush. This may lead to a waste of powder in case when excess powder is dispensed than what is required for application. Additionally, the loose powder may fall out from the perforations into the cap during handling or transportation of the powder dispenser resulting in a mess when the cap is removed.

Moreover, an applicator is required to be carried separately. This results in extra space requirements in order to store the applicator. If not handled appropriately, the applicator may also be deformed.

Therefore, there is a need for a powder container having an integrated applicator and which addresses the stated shortcomings.

Further, even for a non-powder containing container, it is desirable that the container be compact and the applicator be readily available for usage thereby giving the user a functional container requiring less storage space.

SUMMARY

The present invention generally is a container for storing cosmetic or care products. More particularly, the invention relates to a cosmetic container comprising a receptacle and a cover wherein the cover comprises an integrated applicator wherein the applicator is retractable within the cover.

The terms 'protrude' and 'propel' have been used interchangeably herein and refer to the forward displacement of the applicator. Further, the terms 'retract' and 'repel' have been used interchangeably herein and refer to the displacement of the applicator from its protruded position.

According to an embodiment of the invention there is provided a cosmetic container comprising an applicator, so that a user is not required to carry an applicator separately.

According to yet another embodiment of the invention there is provided a container comprising a receptacle and a cover wherein the cover has an integrated applicator. Further, there is provided a mechanism to protrude and retract the applicator while the applicator is integrated with the cover.

In accordance with an embodiment of the invention the mechanism to protrude and retract the applicator may comprise a slider mechanism, a ball-point mechanism, conventional lipstick mechanism, a threaded screw mechanism or any other suitable mechanism that causes protrusion and retraction of the applicator.

According to yet another embodiment of the invention the mechanism of protrusion and retraction is actuated by a suitable actuating means in the cover. The actuating means may be the cover itself, a dialer, a button, a slider or spring actuated actuator or any other suitable actuating means. Further, said actuator may be manually operated or mechanically or power-driven. Further, the protrusion-retraction action of the applicator may occur in a single step or in a series of steps.

According to yet another embodiment of the invention the applicator may be integrated in the cover in such a manner that it can be replaced as and when required by the user. The applicator may be caused to remain inside the cover in retracted position and disengage from the cover in the protruded position.

In accordance with yet another embodiment of the invention the protrusion-retraction action of applicator may cause the applicator to change its physical properties such as its shape/density/form/rigidity/length so as to be able to give the user an option of choosing the kind of applicator required for usage in a single package. In an exemplary embodiment of the invention, the applicator may present itself as a kabuki brush in protruded condition while in retracted position the brush may be caused to come together to form a fan brush thereby giving the user a variety of brushes for usage. In another exemplary embodiment the applicator may be a rigid applicator in retracted position while being flexible when propelled further.

According to an embodiment of the present invention there are provided indicia in the container to indicate to the user if the applicator is in the protruded position or the retracted position. The indicia may comprise a visual indication or a device which gets activated when the applicator is in protruded condition and deactivated in retracted condition. The device may be a suitable device that provides an indication to the user wherein the indication may be in the form of a tactile feel, an audible sound or the device may be an illumination device such as an LED.

According to yet another embodiment of the invention, the propelling-repelling action may cause the applicator to be subjected to at least one additional action or treatment. This additional action may be provided by a suitable means accommodated inside the cover, said means being actuated either in sync with the actuation of the propelling mechanism or may be caused to occur independently. Further, this actuation of the means giving additional treatment to the applicator may be actuated by any suitable mechanism such as either manually actuated or mechanically, electrically, electronically or hydraulically actuated. In an exemplary embodiment of the invention the applicator may be given a treatment such as the applicator may be sanitized while being propelled out. The sanitization may occur by giving any suitable sanitization treatment such as exposure to UV light, blowing a gush of air or subjecting the applicator to a saturated environment before the applicator is fully propelled out. Further, the applicator may be caused to come in contact with a vibration means during propelling so that the propelled applicator vibrates during application. Alternatively the applicator may be caused to move in either a uni-directional motion or in multiple motions or in an irregular motion while it is propelled or after it is propelled for a better application by the user. Further, there may be provided a heating or cooling means inside the cover which heats/cools the applicator for application by the user. Further, these additional treatments may be caused to occur alone or in combination along with the protrusion-retraction of the applicator.

According to yet another embodiment of the invention there is provided a mechanism such that accidental propelling or repelling of the applicator does not occur. There may be provided a suitable means to block the accidental retraction of the applicator into the cover while the applicator is in use in the propelled position. The means may include but is not limited to a protrusion or bump formed on the surface of the cover.

According to yet another embodiment of the invention the cover may comprise a single part or may be made in multiple parts. The cover when in multiple parts may comprise of at least two sections.

According to yet another embodiment of the invention the integrated applicator may be in any suitable form such as a brush, a sponge, a spatula or the like.

According to an exemplary embodiment of the invention there is provided a container for loose powder and a brush integrated with the cover of the container, so that a user may directly use the brush to apply the powder from the container without the need to dispense the powder onto an external surface. The loose powder container incorporates an apparatus to prevent the spilling of the loose powder during handling of the container. Further, there is provided an apparatus to protect the bristles of the brush from being deformed resulting from continuous contact with its surroundings.

According to an exemplary embodiment of the present invention there is provided a container for loose powder having an integrated applicator wherein the applicator is a brush. The container comprises a receptacle and a cap. The receptacle stores powder and optionally includes a perforated panel through which powder can be picked up for application. The cap securely seals the receptacle through a sealing means. The term 'sealing means' herein refers to a suitable means of closing the receptacle such as a thread-screw, a hinge, a magnet or any other suitable means of closing the receptacle by way of cap. The cap further has an applicator brush integrated into the cap and a rotational means to effect the protrusion and retraction of the applicator brush. The cap is further comprised of an upper section and a lower section such that the upper section and the lower section are aligned with respect to each other in an initial position. However, the cap may, in an alternative embodiment, comprise of a single part without being divided into two sections. In the initial position, the brush is in a retracted state in the cap. The user can remove the cap from the receptacle and rotate the upper section with respect to the lower section of the cap in a first direction to misalign the two sections. This misalignment of the upper section and the lower section in the first direction results in the brush to start protruding from the cap. The brush is completely protruded once the upper section and the lower section are re-aligned at 180 degrees in the first direction. The user can then twirl the fully protruded brush inside the receptacle over the perforated panel to pick powder for application. Once the powder has been applied using the protruded brush, the upper section is rotated in the reverse direction to align with the lower section in the initial position, in which position the brush is completely retracted into the cap. The cap is then screwed onto the receptacle.

According to yet another embodiment of the invention there is provided a container comprising a receptacle, a cover and an applicator. The receptacle comprises a housing for storing the product. The cover comprises a housing that accommodates an applicator and a protrusion retraction mechanism assembly such that the applicator is integrated within the cover. The mechanism to protrude and retract the applicator may comprise a slider mechanism, a ball-point mechanism, conventional lipstick mechanism, a threaded screw mechanism or any other suitable mechanism that causes protrusion and retraction of the applicator. Further, the mechanism of protrusion and retraction is actuated by a suitable actuating means in the cover. The actuating means comprise a dialer, a button, a slider or spring actuated actuator or any other suitable actuating means. Further, said actuator may be manually operated or mechanically or power-driven. Further, the protrusion-retraction action of the applicator may occur in a single step or in a series of steps.

These and further aspects which will be apparent to the expert of the art are attained by a cosmetic container in accordance with the main claim.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
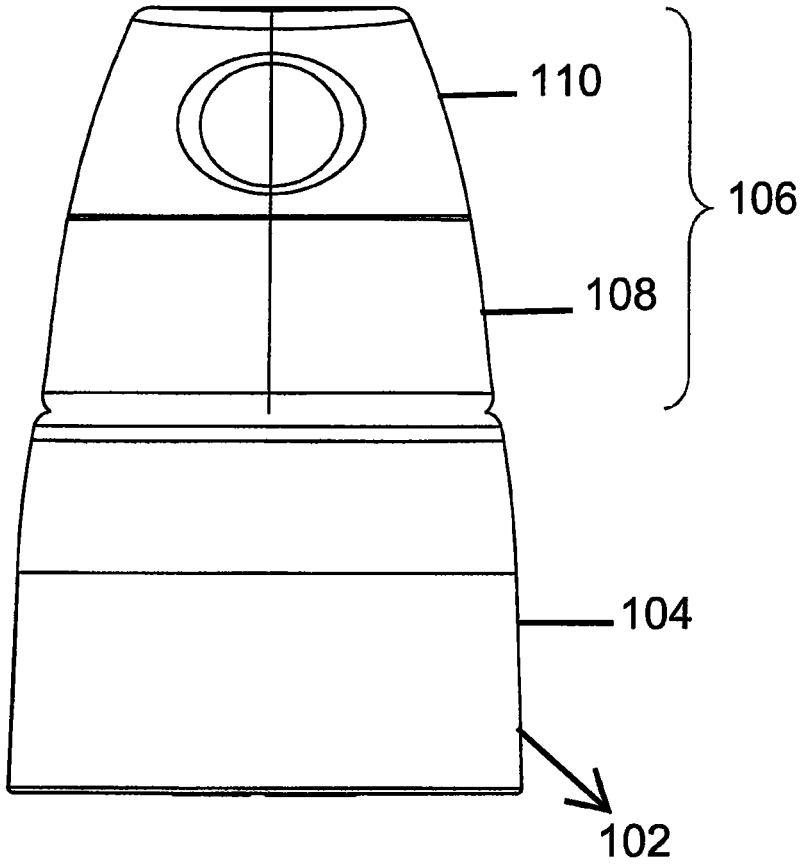
FIG. 1 is a front view of a cosmetic container in accordance with an embodiment of the present invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

The cosmetic container according to one embodiment of the present invention is shown in FIGS. 1 through to 6. The cosmetic container includes a cap that securely seals the container through a sealing apparatus. The term 'sealing apparatus' or 'sealing means' as used herein refers to a suitable means of closing the receptacle such as a thread-screw, a hinge, a magnet or any other suitable means of closing the receptacle by way of cap. The cap is split into two sections which are aligned with respect to each other in an initial position. However, the cap may, in an alternative embodiment, comprise of a single part without being divided into two sections. A brush or any other suitable applicator is integrated into at least one of the sections of the cap, thereby eliminating the need for a user to carry an applicator separately. Once the cap has been unscrewed from the container, an upper section of the cap can be rotated with respect to a lower section of the cap to extend or protrude the brush so that the user may apply the powder using the protruded brush.

FIG. 1 is a front view of a cosmetic container 102, said container being shown to contain cosmetic powder, however, any other suitable cosmetic product may be stored in the cosmetic container of the present invention. The container 102 includes a receptacle 104 and a cap 106. The receptacle 104 may contain loose powder. Cap 106 securely seals receptacle 104 through a sealing apparatus. Further, the cap 106 includes two sections, an upper section 110 and a lower section 108. Upper section 110 is movable relative to lower section 108 through a rotational apparatus accommodated inside the cap 106. In accordance with an embodiment the cap 106 has an ergonomic shape to enable a user to easily grip rotational apparatus of the cap 106. Further, as represented by FIGS. 2 through to 6, the cap 106 includes a brush applicator 202 integrated into cap 106. Further, the receptacle 104 includes a perforated panel 306 through which powder can be picked up by a brush applicator 202 for application. However, in an alternative embodiment the container may not contain a perforated panel depending upon the kind of cosmetic product being stored therein. In an embodiment, receptacle 104 is also called outer jar. Additionally, in an embodiment, the perforated panel 306 is called the inner jar. Further, the cap 106 may include any other kind of applicator as well such as a sponge, a spatula or the like. This brush applicator 202 is positioned in a retracted state inside cap 106 when cap 106 seals the receptacle 104.

Figure 2A:
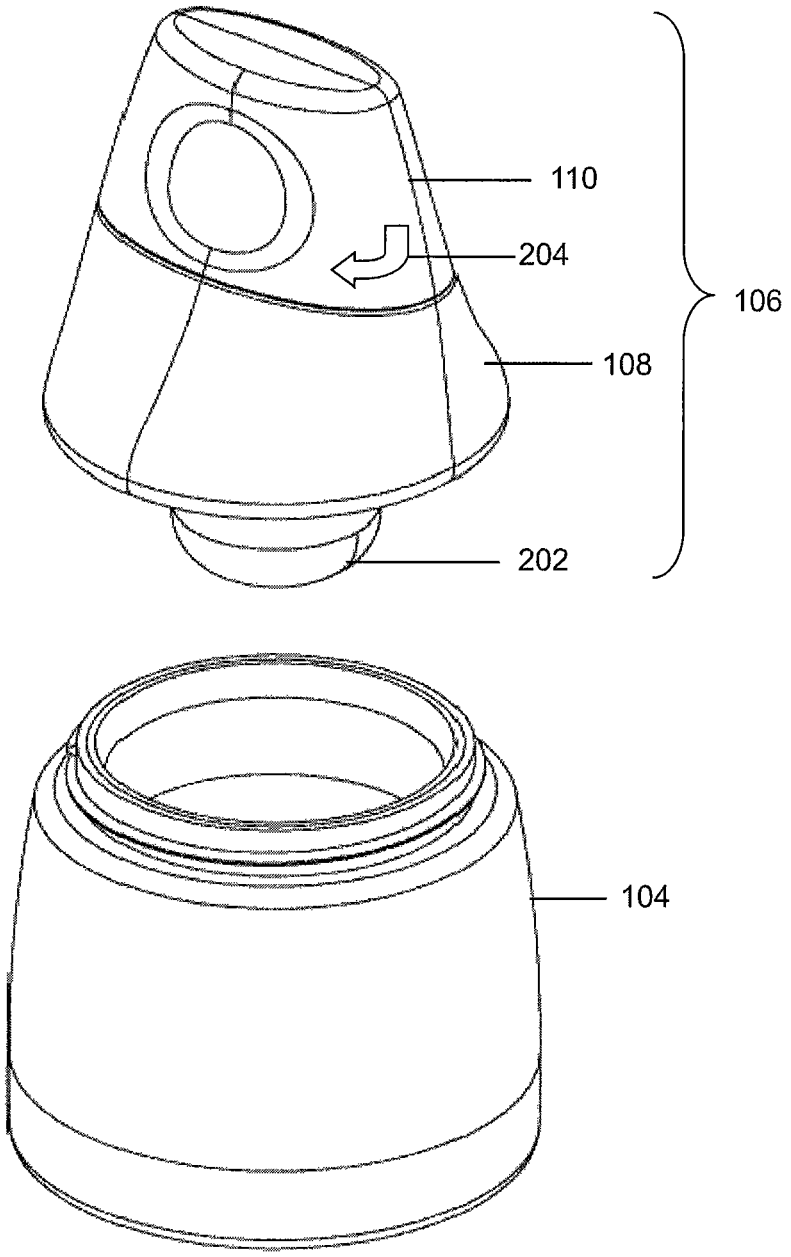
FIG. 2A illustrates a perspective view of the container of FIG. 1 with a cap unscrewed from a receptacle and an upper section and a lower section of the cap aligned with respect to each other in an initial position.

FIG. 2A illustrates the container 102 with the cap 106 unscrewed and separated from the receptacle 104 in accordance with an embodiment of the present invention. Cap 106 includes a brush applicator 202, which is illustrated in the figure to be integrated into the cap 106. Brush applicator 202 can be protruded or extended from and retracted into cap 106. This is achieved by rotating the upper section 110 of the cap 106 with respect to the lower section 108 of cap 106. Upper section 110 and lower section 108 of cap 106 are illustrated to be in an aligned arrangement in FIG. 2A. In this initial arrangement, the brush applicator 202 is positioned inside the cap 106 in a retracted state. Brush applicator 202 is received into receptacle 104 in a retracted state when cap 106 seals receptacle 104. In accordance with an embodiment, brush applicator 202 is formed of a tuft of bristles which has an approximate pear shape. In accordance with an embodiment, the tuft may be formed from either synthetic or natural bristles.

Figure 2B:
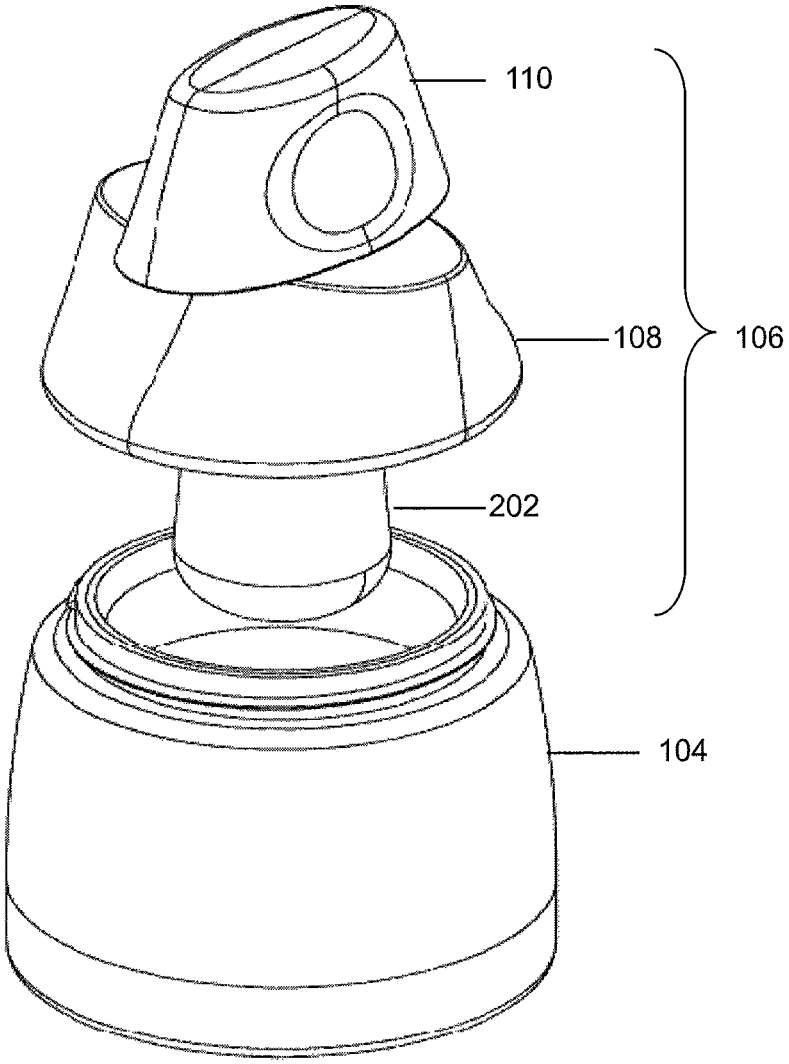
FIG. 2B illustrates the container of FIG. 1 with the cap unscrewed and the upper section and the lower section of the cap rotated with respect to each other in a predetermined direction to be in a misaligned arrangement to protrude a brush.

FIG. 2B illustrates the container 102 with the cap unscrewed and upper section 110 and lower section 108 rotated with respect to each other to be in a misaligned arrangement to start the protrusion or extension of the brush applicator 202. Once a user unscrews cap 106, the brush applicator 202 is in a retracted position within the cap 106. In this initial position, upper section 110 and lower section 108 are in an aligned arrangement with respect to each other (as illustrated in FIG. 2A). To protrude or extend the brush applicator 202, the user rotates upper section 110 with respect to lower section 108 in a predetermined direction. In accordance with one embodiment of the invention, upper section 110 is rotated in a clockwise direction. FIG. 2B illustrates a half-rotation between upper section 110 and lower section 108, where both sections are misaligned at approximately 90 degrees with respect to each other. In this arrangement, brush applicator 202 is in the process of being protruded or extended from cap 106.

Figure 2C:
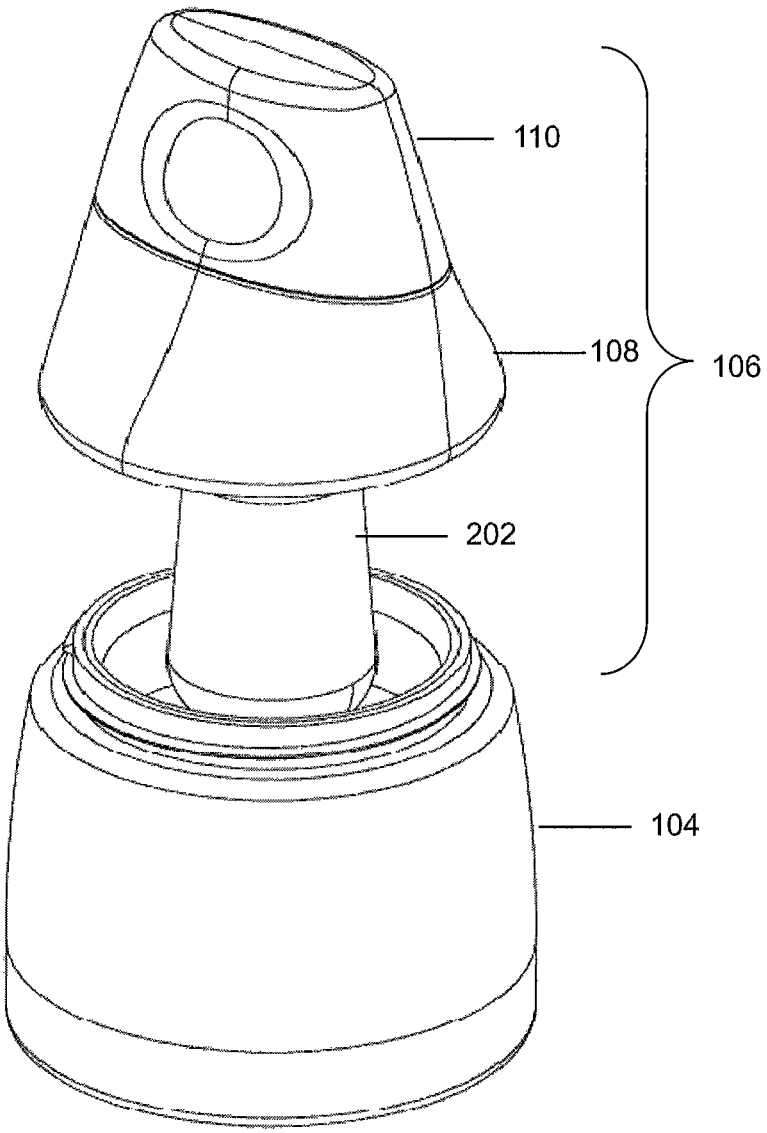
FIG. 2C illustrates the container of FIG. 1 with the cap unscrewed and the upper section and the lower section of the cap rotated with respect to each other to be completely realigned in the predetermined direction to completely protrude the brush.

FIG. 2C illustrates container 102 with cap 106 unscrewed and separated. Upper section 110 is completely rotated in order to be realigned at approximately 180 degrees with lower section 108, in which position, brush applicator 202 is completely protruded or extended from cap 106. In accordance with this embodiment of the cap 106, there is no possibility for confusion for a user regarding the degree of rotation required to fully protrude or extend the brush. The form of the cap 106 breaks or misaligns and then re-aligns to convey to the user that the rotation is complete and the brush applicator 202 is fully extended in that state. In accordance with an embodiment, the effective length of the bristles in a fully extended brush is approximately 23 mm, from the tip of the bristles to the top base of lower section 108. Other lengths are within the scope of the invention.

In accordance with an embodiment, a rotation complete indicator 204 as shown in FIG. 2A is provided on the cap 106, which indicates the direction in which the user should rotate upper section 110 with respect to lower section 108. Further, rotation complete indicator 204 only permits the upper section 110 and the lower section 108 to be rotated for alignment and realignment to the extent of approximately 180 degrees and prevents further rotation between the two sections. In accordance with an embodiment of the cap 106, a stopper between upper section 110 and lower section 108 can prohibit further rotation of upper section 110 in the direction of its rotation, once upper section 110 is aligned with lower section 108 at 180 degrees.

Figure 3:
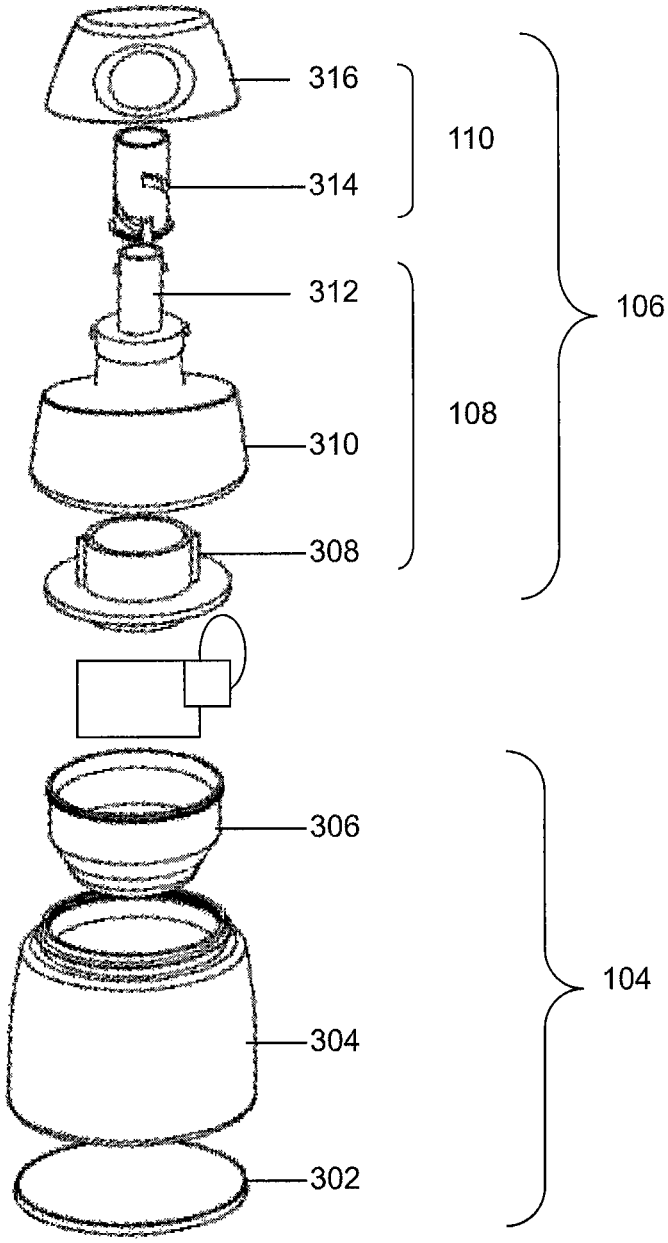
FIG. 3 is an exploded view of a cosmetic container in accordance with an exemplary embodiment of the present invention.

FIG. 3 is an exploded view of the container 102 in accordance with an exemplary embodiment of the present invention. Specifically, FIG. 3 illustrates the various components comprised in receptacle 104 and cap 106 in accordance with an embodiment. As illustrated in FIG. 3, receptacle 104 includes a bottom disc 302, an outer jar or the receptacle 304, and an inner jar or the perforated panel 306. Bottom disc 302 provides the base for outer jar 304 on which outer jar 304 can be positioned. In accordance with an embodiment, bottom disc 302 is made from Polypropylene or any other suitable material. Bottom disc 302 can be detached from outer jar 304 to fill outer jar 304 with powder. Thus in accordance with an embodiment, bottom disc 302 affords a refilling apparatus for the loose powder container of the present invention. Outer jar 304 is filled with powder and serves as the container or receptacle for the storage of powder. In accordance with an embodiment, outer jar 304 can be a pot-shaped circular jar with vertical sides and a narrow opening on the top. The shape of the outer jar 304 has been described in detail in conjunction with FIG. 4. However any other suitable shapes are also possible. Outer jar 304 includes an inner jar 306 which is detachable from outer jar 304. Inner jar 306 is circular and has curved concave side walls. In accordance with an embodiment, inner jar 306 is made of Polypropylene or any suitable material. As represented by FIG. 5, the bottom of inner jar 306 is substantially flat and includes perforations 502 like a sieve, however, any other suitable shape of inner jar and sieve are within the scope of this invention. The perforations 502 enable the powder in outer jar 304 to be picked through inner jar 306 by twirling brush applicator 202 in it.

The various components which are comprised in cap 106 are now described. As described in conjunction with FIGS. 1 through to 3, the cap 106 includes a lower section 108 and an upper section 110. In accordance with an embodiment, lower section 108 includes a seal disc 308, a lower cap 310 and a brush holder 312. Also, in accordance with an embodiment, upper section 110 includes a center bar 314 and an upper cap 316. Seal disc 308 is attached to lower cap 310. In accordance with an embodiment seal disc 308 may be made of polypropylene. Seal disc 308 is a circular disc with a concentric hollow circle in its center. The concentric hollow circle is preferably surrounded by a circular and vertical wall with vertically protruding channels on two opposite sides. The hollow circular center of seal disc 308 enables a brush to pass through seal disc 308 to inner jar 306. The circular and vertical wall acts as a protective collar for the brush and its bristles. The brush protector collar protects the bristles of the brush from deformation when the brush protrudes and retracts. The vertically protruding channels on the circular and vertical wall enable seal disc 308 to permanently fit itself inside the inner wall of lower cap 310. The inner wall of lower cap 310 also includes hollow vertical channels to fit the protruding channels of seal disc 308. Lower cap 310 is circular in shape and configured such that it fits onto the narrow opening on the top of outer jar 304. In accordance with an embodiment, lower cap 310 has helical grooves on the bottom part of its inner wall. These helical grooves cooperate or interface with the lower cap 310 with outer jar 304 to enable the sealing and opening of the powder container. However, the invention should not be construed to be limited to the use of interlocking helical grooves as the sealing apparatus means for the powder container. Other commonly known mechanisms can also be used for the purpose. In accordance with an embodiment, lower cap 310 has a narrower shape on its top and widens towards its bottom. Also, in an embodiment, lower cap 310 is oval and flat in shape towards its top. Further, lower cap 310 is hollow in shape to allow a brush to pass through lower cap 310 into inner jar 306. In addition, the inner part of the flat top of lower cap 310 includes opposite pair of vertical hollow channels. These channels provide a mechanism to fit brush holder 312 to lower cap 310. In accordance with an embodiment lower cap 310 may be made of Acrylonitrile Butadiene Styrene (ABS). However, other suitable materials and shapes for cap are possible. Brush holder 312 has a circular base with a hollow circular center. Outer walls of the circular base have a pair of opposite protruding channels that fit into the vertical hollow channels of the flat top of lower cap 310. The hollow circular center of brush holder 312 is surrounded by a vertically protruding wall. The inner side of the vertically protruding wall holds the brush. The outer side of the vertically protruding wall of brush holder 312 has a pair of opposite protruding notches. These notches fit inside sliding channels on the vertical walls of center bar 314. In accordance with an embodiment brush holder 312 may be made of polypropylene. Center bar 314 is a cylindrical device which has a spiral-shaped hollow channel on its wall. In accordance with an embodiment center bar 314 may be made of Acrylonitrile Butadiene Styrene (ABS). Protruding notches of brush holder 312 are engaged in the hollow channel. Center bar 314 is further attached to upper cap 316. Upper cap 316 is configured in an oval shape to match the shape of the upper part of lower cap 310. Upper cap 316 can be rotated with respect to lower cap 310. The brush is fixed to the inner top part of upper cap 316. In an embodiment, the inner top part of upper cap 316 is flat. The brush fixed inside upper cap 316 passes through center bar 314 and brush holder 312. In accordance with an embodiment upper cap 316 may be made of Acrylonitrile Butadiene Styrene (ABS). The various components and sections of the cap 106 as described above are in accordance with a specific embodiment of the invention, however, the invention should not be construed to be limited to them and other known variations in the shapes, sizes and construction are also possible for effecting the protrusion/retraction and protection of the applicator.

The operation of the powder container for application of the powder is described hereafter in accordance with the embodiment described in FIGS. 3 through to 6. The container is opened by unscrewing cap 106 from receptacle 104, that is, lower cap 310 unscrews outer jar 304. A user rotates upper cap 316 in one direction. Upon rotating upper cap 316, center bar 314 also rotates. The rotation of center bar 316 causes the notches of brush holder 312 to slide down on its hollow spiral-shaped channel. The downward sliding movement causes the brush inside brush holder 312 to also slide downwards, hence causing the brush 202 to protrude. In accordance with an embodiment, the rotation apparatus of cap 106 includes the center bar 314 which when rotated causes the movement of the upper cap 316 with respect to the lower cap 310, both being comprised in cap 106. Further, the mechanism incorporated in the shape of the brush holder which causes the downward sliding movement of the brush upon rotation is the protrusion apparatus in accordance with the embodiment of the present invention. The rotation of upper section 110 and lower section 108 with respect to each other causing the resulting protrusion of brush 202 is not only limited to the mechanism described herein. Any other mechanism may be used for the purpose.

Figure 4:
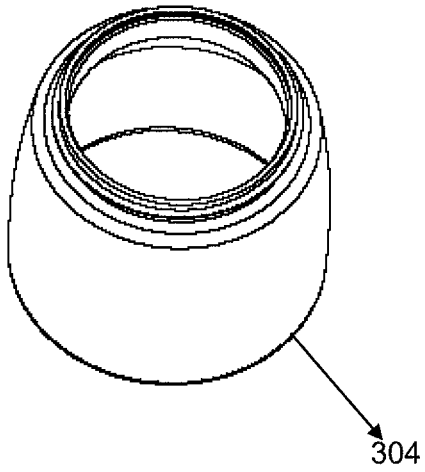
FIG. 4 is a perspective view of an outer jar of receptacle of container of FIG. 3.
Figure 5:
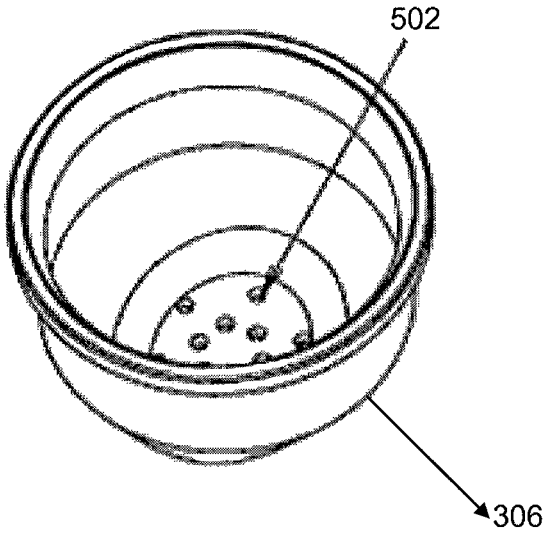
FIG. 5 is a perspective view of an inner jar of receptacle of container of FIG. 3.

FIG. 4 illustrates an outer jar 304 in accordance with an embodiment of the receptacle of the present invention. The outer jar 304 illustrated in FIG. 4 has a narrow opening at the top. This narrow opening may include helical grooves on its outer wall. The helical grooves provide an interfacing mechanism for locking cap 106 of the powder container with respect to the outer jar 304 and consequently with respect to receptacle 104. Alternatively, other commonly known interfacing mechanisms, such as a click-lock mechanism, can also be used for the sealing of the outer jar 304. In an embodiment, the narrow circular opening of outer jar 304 has a diameter of approximately 38 mm and the broader circular base of outer jar 304 has a diameter of approximately 50.8 mm. Also, in accordance with an embodiment, the height of outer jar 304 is approximately 43 mm. However, all the dimensions of outer jar 304 should not be construed to be limited to the numbers mentioned above. These dimensions may vary with other embodiments. Further, in accordance with an embodiment, outer jar 304 may be made of Styrene-Acrylonitrile or any other suitable material.

FIG. 5 illustrates an inner jar 306 in accordance with an embodiment of the receptacle of the present invention. Inner jar 306 comprises perforations 502. In accordance with an embodiment, perforations 502 are small orifices. However other shapes of perforations can also be used. Additionally, the size of perforations 502 can be determined based on the utility of the powder container and the amount of powder desired for application. For instance, the size of the perforations can be smaller if the powder container is meant for cosmetic blush powder. In another case, a larger size of perforations can be configured if the powder container is to be used for applying face powder. In accordance with an embodiment, the diameter of the broad top side of inner jar 306 is approximately 36.6 mm and that of its narrow bottom side is less than approximately 35 mm. Also, in accordance with an embodiment, the height of inner jar 306 is approximately 23.04 mm. However, all the dimensions of inner jar 306 should not be construed to be limited to the numbers mentioned above. These dimensions may vary with other embodiments.

Figure 6:
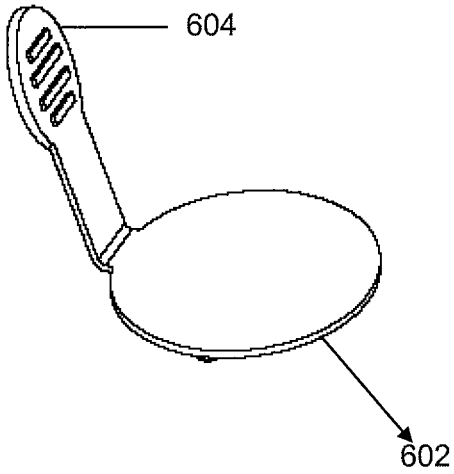
FIG. 6 illustrates a protective disc of receptacle of container of FIG. 3 with an embodiment of the present invention.

In accordance with another embodiment of the invention, inner jar 306 is covered with a protective disc 602 as represented by FIG. 6. Protective disc 602 seals the perforations in inner jar 306 to prevent the spilling of the powder from the receptacle during handling or transportation of the powder container. The protective disc 602 should be removed to apply the powder from the powder container in accordance with the various embodiments of the invention. In accordance with an embodiment, the protective disc may be made from polypropylene. An exemplary protective disc 602 is illustrated in FIG. 6. A tab 604 emerging from protective disc 602 can be used to pull the disc out from the receptacle and render the perforations open for application of the powder.

Figure 7:
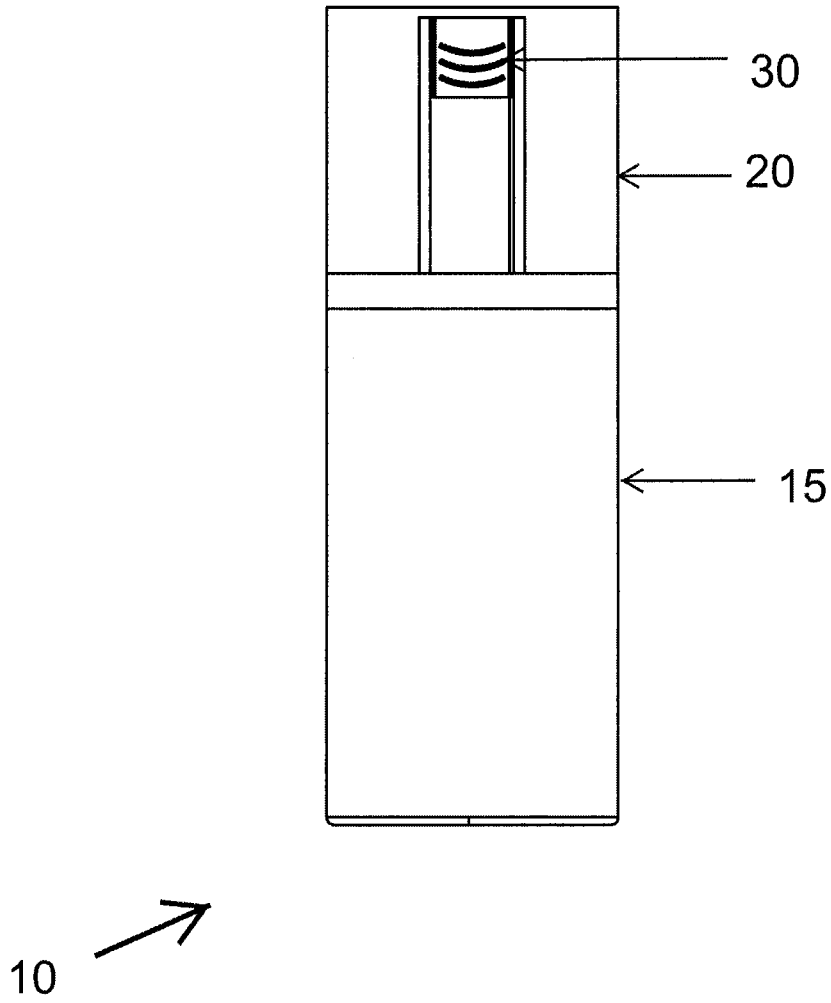
FIG. 7 illustrates an isometric view of a cosmetic container according to one embodiment of the invention.
Figure 8:
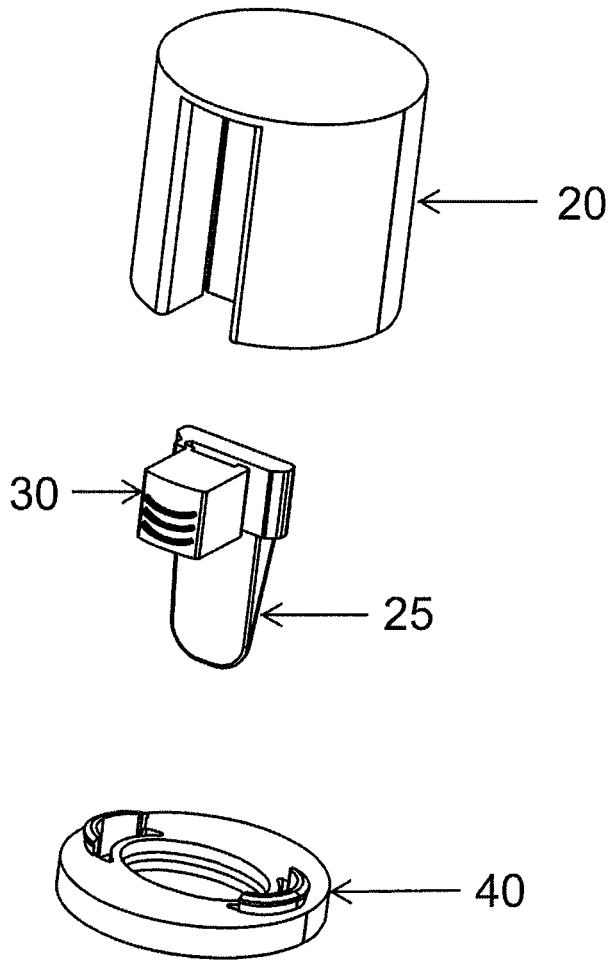
FIG. 8 illustrates an exploded view of cover of container of FIG. 7.
Figure 9:
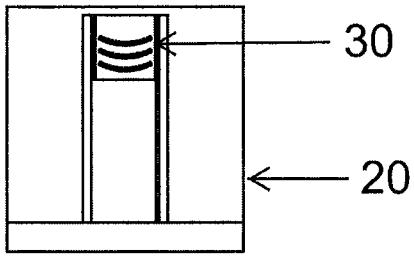
FIG. 9 illustrates a perspective view of cover of the container of FIG. 7 showing the applicator in retracted position.
Figure 10:
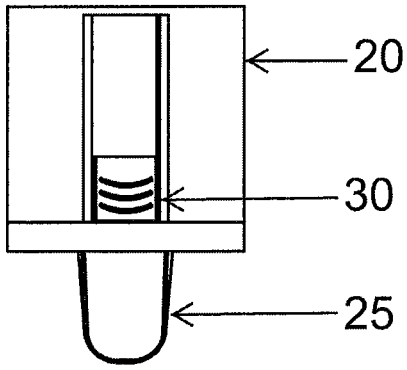
FIG. 10 illustrates a perspective view of cover of the container of FIG. 7 showing the applicator in protruded position.
Figure 11:
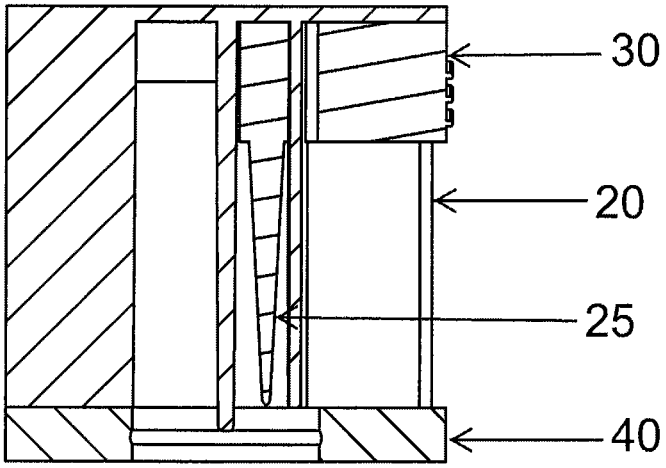
FIG. 11 illustrates cross section view of cover of the container of FIG. 7.

FIGS. 7 through to 11 are illustrating the container according to another exemplary embodiment of the present invention. As represented by the FIGS. 7 through to 11, the container 10 comprises a receptacle 15 and a cover 20. The receptacle 15 comprises a housing for storing the product. The cover 20 comprises a housing which accommodates an applicator 25 and a protrusion retraction mechanism assembly for operating the applicator 25 such that the applicator 25 is integrated within the cover 20. The cover 20 and receptacle 15 are connected by a suitable closure means in a manner permitting their relative movement with respect to one another to open and close the container 10. The closure means may comprise a hinge, a pin, a snap, a hook, a threaded screw arrangement or any suitable means. The FIGS. 7 through to 11 illustrate the protrusion retraction assembly as a slider mechanism assembly to protrude and retract the applicator 25, however any suitable protrusion-retraction mechanism may be present such that it integrates the applicator 25 in the cover 20 and the applicator 25 is retractable within the cover 20. Also, alternatively, the protrusion-retraction mechanism may comprise a ball-point mechanism, conventional lipstick mechanism, a threaded screw mechanism or any other suitable mechanism that causes protrusion and retraction of the applicator. Further, the mechanism of protrusion and retraction is actuated by a suitable actuating means. As represented in FIGS. 7 through to 11, an actuating means 30 is present in the cover 20. As shown, the actuating means 30 is a button for causing the sliding action, however, the actuating means may comprise a dialer, a button, a slider or spring actuated actuator or any other suitable actuating means. Further, said actuating means 35 may be manually operated or mechanically or power-driven. Further, the protrusion-retraction action of the applicator 25 may occur in a single step or in a series of steps. The FIG. 8 illustrates the assembly of the cover 20 which comprises a slider button 30, an applicator 25 and a plug 40 of the cover 20. FIG. 9 shows the applicator 25 in retracted position while FIG. 10 shows the applicator 25 in protruded position. During usage, the user opens the cover 20 from the receptacle 15 and using the slider button 30 protrudes the applicator 25 for application and post application, retracts the applicator 25 into the cover 20 using the slider button 30 and closes the container.

Figure 12:
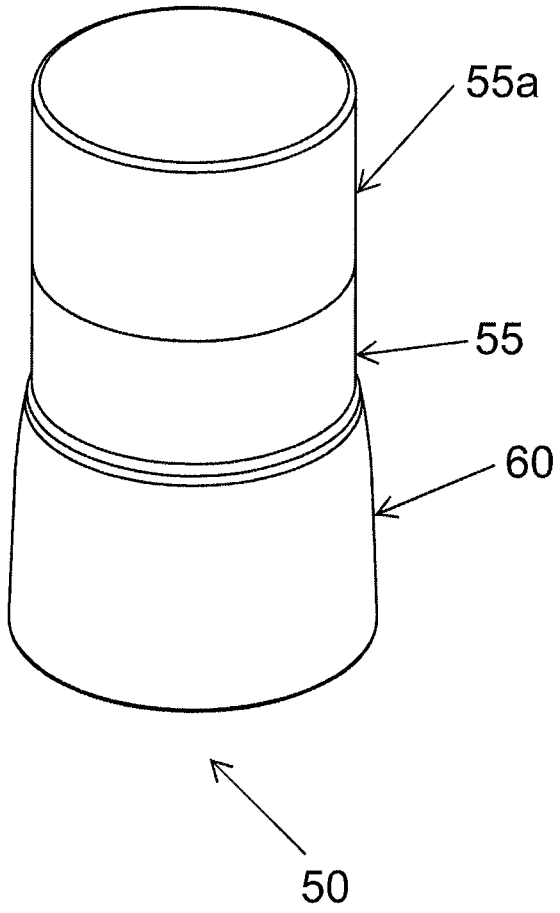
FIG. 12 illustrates isometric view of a cosmetic container according to another embodiment of the invention.
Figure 13:
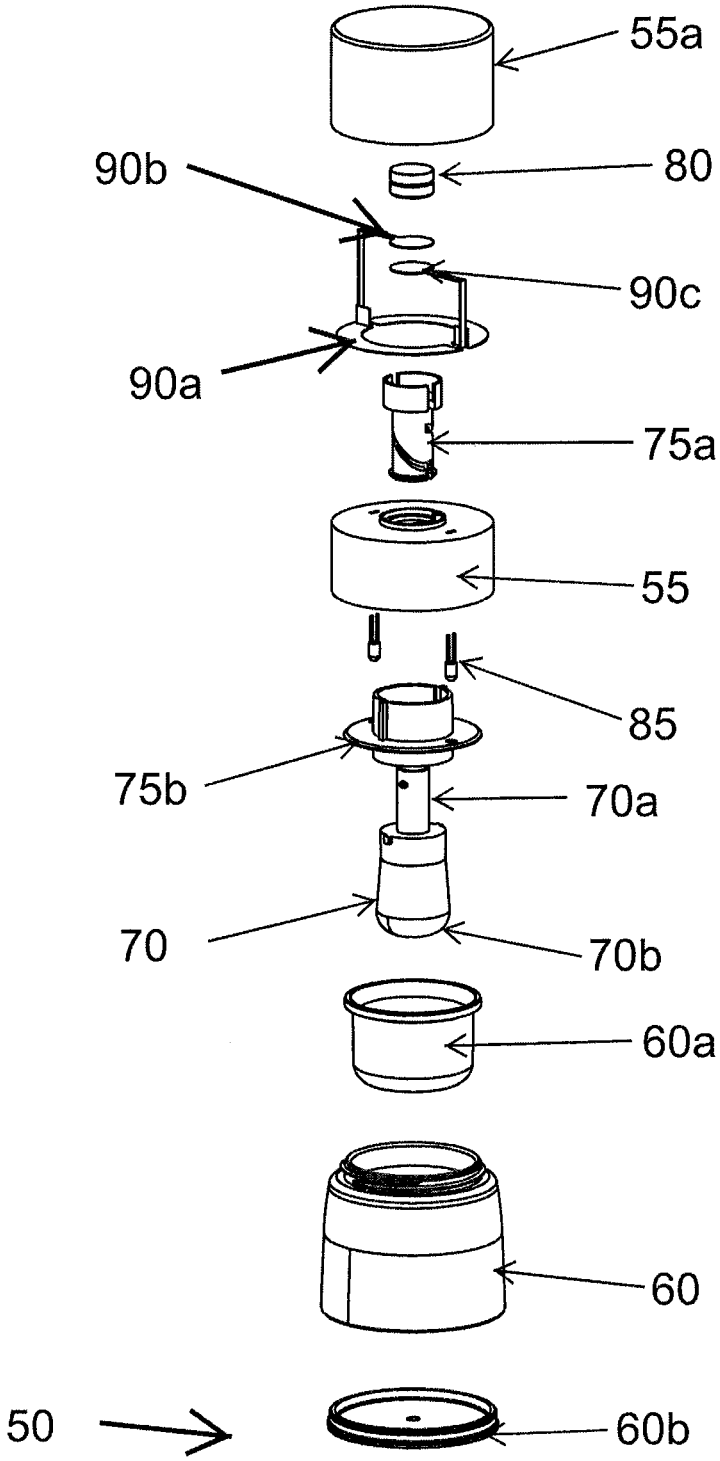
FIG. 13 illustrates exploded view of container of FIG. 12.
Figure 14:
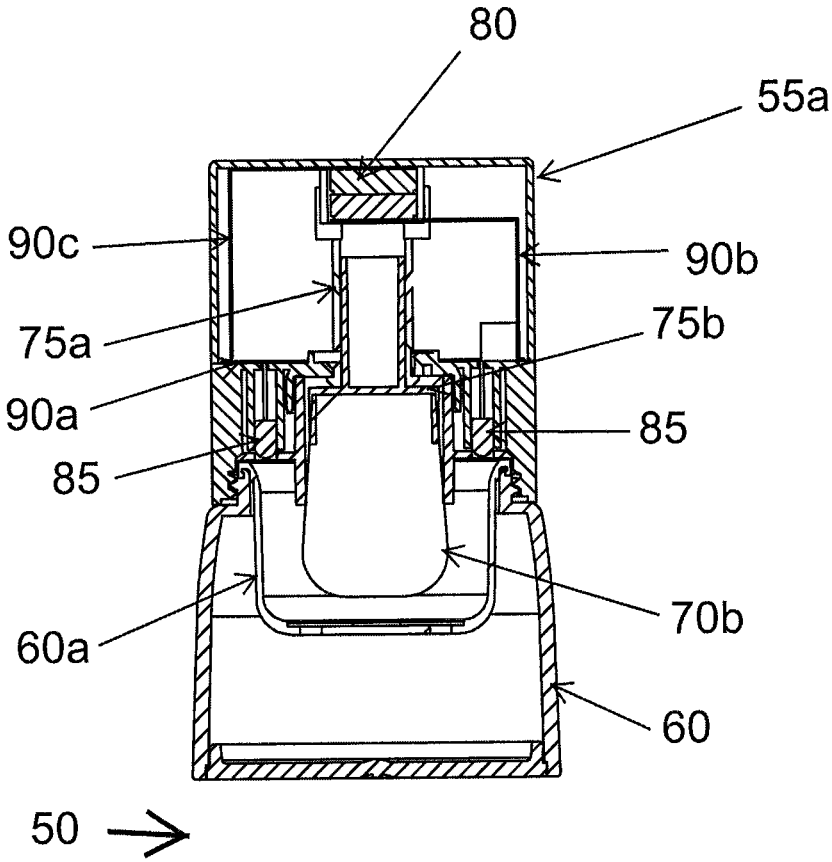
FIG. 14 illustrates cross sectional view of container of FIG. 12.

FIGS. 12 through to 14 show the container according to yet another exemplary embodiment of the invention. As represented in FIG. 12 the container 50 comprises a cover 55 and a receptacle 60. The cover 55 and receptacle 60 are connected by a suitable closure means in a manner permitting their relative movement with respect to one another to open and close the container 50. The closure means may comprise a hinge, a pin, a snap, a hook, a threaded screw arrangement or any suitable means. The receptacle 60 comprises a housing that accommodates a product. The receptacle 60 may further comprise a sieve/sifter 60*a* and a base plug 60*b*. The cover 55 further comprises an actuating means 55*a*, an applicator 70 and a protrusion retraction mechanism assembly for operating the applicator 70 such that the applicator 70 is integrated within the cover 55. As illustrated in FIG. 13 the protrusion retraction assembly comprises a rotational apparatus 75*a* such as a helix and an applicator holder 75*b*. The applicator 70 comprises a stem 70*a* and an application element 70*b*. The applicator stem 70*a* is arranged to be movable inside the helix for being protruded and retracted by the actuating means 55*a*. As represented by the FIGS. 12 through to 14, the actuating means 55*a* is a section of the cover 55 that acts as a dialer. However, the actuating means may be a button, a slider or spring actuated actuator or any other suitable actuating means. Further, said actuator may be manually operated or mechanically or power-driven. Further, the protrusion-retraction action of the applicator may occur in a single step or in a series of steps. The protrusion-retraction assembly further accommodates a system for activating and deactivating a light source. The system comprises an energy source 80 and a light source 85 wherein the light source 85 is arranged to be operated by the energy source 80. The light source 85 is connected to the energy source 80 by a connecting means 90. As shown in the FIGS. 13 and 14, the light source 85 such as an LED is connected to the energy source 80 such as a battery by a metallic connector 90*a*. The metallic connector 90*a* has two terminals i.e. positive terminal 90*b* and a negative terminal 90*c*. Further, the light source 85 such as the LED are arranged to be accommodated inside the applicator holder 75*b*. During usage, the user opens the cover and then actuates the actuating means to propel out the applicator and simultaneously the light source also gets activated. The LED are arranged to be activated when the actuator is actuated to propel the applicator. However, the LED may alternatively be arranged to be activated independently as per user's requirement. The present exemplary embodiment of the invention illustrates the container as having an integrated applicator wherein alongwith the protrusion and retraction of the applicator, a light source is also activated and deactivated respectively. However, as an alternative embodiment the protrusion retraction of the applicator may cause the applicator to be subjected to at least one of any other additional action or treatment. This additional action may be provided by a suitable means accommodated inside the cover, said means being actuated either in sync with the actuation of the propelling mechanism or may be caused to occur independently. Further, this actuation of the means giving additional treatment to the applicator may be actuated by any suitable mechanism such as either manually actuated or mechanically, electrically, electronically or hydraulically actuated. In an exemplary embodiment of the invention the applicator may be given a treatment such as the applicator may be sanitized while being propelled out. The sanitization may occur by giving any suitable sanitization treatment such as exposure to UV light, blowing a gush of air, subjecting the applicator to a saturated environment before the applicator is fully propelled out. Further, the applicator may be caused to come in contact with a vibration means during propelling so that the propelled applicator vibrates during application. Alternatively the applicator may be caused to move in either a uni-directional motion or in multiple motions or in an irregular motion while it is propelled or after it is propelled for a better application by the user. Further, there may be provided a heating or cooling means inside the cover which heats/cools the applicator for application by the user.

As represented by FIGS. 1 through to 14, the mechanism of protrusion and retraction is actuated by a suitable actuating means in the cover. The actuating means may be the cover itself, a dialer, a button, a slider or spring actuated actuator or any other suitable actuating means. Further, said actuator may be manually operated or mechanically or power-driven. Further, the protrusion-retraction action of the applicator may occur in a single step or in a series of steps.

Further, the container may be formed from any suitable material or a polymeric material such as PCTA. The cover may be formed from any suitable material or a polymeric material such as polypropylene, acrylonitrile butadiene styrene or styrene acrylonitrile or any other suitable material. The applicator stem may be formed of any suitable material or a polymeric material such as acrylonitrile butadiene styrene. Further, depending upon the cosmetic material being used, a variety of sizes and shapes of the applicator element can be utilized. The applicator element may be constructed of a porous or non-porous rubber, fabric mesh, felt material, foamed polymers, sponge material or any other suitable material. Also, the applicator element could have any suitable shape depending on the kind of application required. It could have a shape other than round such as flattened brushes on the end of the applicator rod.

Various examples of the cosmetic products where the container of the present invention could be used are but not limited to a loose powder, baked or pressed product such as an eye shadow, rouge, a blusher or a foundation.

According to yet another embodiment of the invention the applicator may be integrated in the cover in such a manner that it can be replaced as and when required by the user. The applicator may be caused to remain inside the cover in retracted position and disengage from the cover in the protruded position.

In accordance with yet another embodiment of the invention the protrusion-retraction action of applicator may cause the applicator to change its physical properties such as its shape/density/form/rigidity/length so as to be able to give the user an option of choosing the kind of applicator required for usage in a single package. In an exemplary embodiment of the invention, the applicator may present itself as a kabuki brush in protruded condition while in retracted position the brush may be caused to come together to form a fan brush thereby giving the user a variety of brushes for usage. In another exemplary embodiment the applicator may be a rigid applicator in retracted position while being flexible when propelled further.

According to an embodiment of the present invention there are provided indicia in the container to indicate to the user if the applicator is in the protruded position or the retracted position. The indicia may comprise a visual indication or a device which gets activated when the applicator is in protruded condition and deactivated in retracted condition. The device may be a suitable device that provides an indication to the user wherein the indication may be in the form of a tactile feel, an audible sound or the device may be an illumination device such as an LED.

According to yet another embodiment of the invention, the propelling-repelling action may cause the applicator to be subjected to at least one additional action or treatment. This additional action may be provided by a suitable means accommodated inside the cover, said means being actuated in sync with the actuation of the propelling mechanism. Further, this actuation of the means giving additional treatment to the applicator may be actuated by any suitable mechanism such as either manually actuated or mechanically, electrically, electronically or hydraulically actuated. In an exemplary embodiment of the invention the applicator may be given a treatment such as the applicator may be sanitized while being propelled out. The sanitization may occur by giving any suitable sanitization treatment such as exposure to UV light, blowing a gush of air, subjecting the applicator to a saturated environment before the applicator is fully propelled out. Further, the applicator may be caused to come in contact with a vibration means during propelling so that the propelled applicator vibrates during application. Alternatively the applicator may be caused to move in either a uni-directional motion or in multiple motions or in an irregular motion while it is propelled or after it is propelled for a better application by the user. Further, there may be provided a heating or cooling means inside the cover which heats/cools the applicator for application by the user.

According to yet another embodiment of the invention there is provided a mechanism such that accidental propelling or repelling of the applicator does not occur. There may be provided a suitable means to block the accidental retraction of the applicator into the cover while the applicator is in use in the propelled position. The means may include but is not limited to a protrusion or bump formed on the surface of the cover.

According to yet another embodiment of the invention the cover may comprise a single part or may be made in multiple parts. The cover when in multiple parts may comprise of at least two sections.

According to yet another embodiment of the invention the integrated applicator may be in any suitable form such as a brush, a sponge, a spatula or the like.

These and further aspects which will be apparent to the expert of the art are attained by a cosmetic container in accordance with the main claim.

While the foregoing is directed to embodiments of the present invention, other and further embodiments of the invention may be devised without departing from the basic scope thereof, and the scope thereof is determined by the claims that follow.

What is claimed is:

1. A cosmetic container comprising: a receptacle, the receptacle comprising:

a housing for storing a cosmetic product;

a cover, the cover comprising an upper section and a lower section;

an applicator integrated in the cover and movable between protruded and retracted positions, the applicator picking the cosmetic product through the receptacle when the applicator is in the protruded position; and a rotational apparatus to move the applicator between the protruded and retracted positions;

wherein the upper section and the lower section of the cover are connected through the rotational apparatus and wherein the upper section and the lower section of the cover are rotated with respect to each other to protrude and retract the applicator;

wherein the applicator is in a completely protruded and retracted position when the upper section and the lower section are in completely flush and contiguous alignment;

wherein the rotation of the upper section of the cover with respect to the lower section in a first direction causes misalignment of the upper and lower sections such that the upper section and the lower section of the cover are no longer flush and contiguous with each other; wherein the misalignment indicates initiation of protrusion or retraction of the applicator;

wherein further rotation in the first direction of the upper section of the cover with respect to the lower section causes flush and contiguous re-alignment of the upper section and the lower section of the cover indicating that the applicator is completely moved to the protruded position; and wherein further rotation of the upper section of the cover with respect to the lower section in reverse direction causes flush and contiguous re-alignment of the upper section and the lower section of the cover indicating that the applicator is completely moved to the retracted position.

2. The cosmetic container of claim 1 wherein the upper section and the lower section of the cover are rotated with respect to each other to protrude and retract the applicator either manually or mechanically or power-driven.

3. The cosmetic container of claim 2 wherein the protrusion-retraction of applicator causes the applicator to change its physical properties.

4. The cosmetic container of claim 3 wherein the physical property is one of applicator shape, density, form, rigidity or length.

5. The cosmetic container of claim 3 wherein one of the receptacle or cover of the container comprises indicia to indicate to the user the protruded position or the retracted position of the applicator.

6. The cosmetic container of claim 5 wherein the indicia comprise a visual indication or a device which gets activated when the applicator is in protruded position and deactivated when the applicator is in the retracted position wherein the indication is in the form of a tactile feel, an audible sound or a visual indication.

7. The cosmetic container of claim 1 wherein the rotational apparatus performing the protrusion and the retraction of the applicator further accommodates a system for providing an additional treatment to the applicator as the applicator protrudes and retracts.

8. The cosmetic container of claim 7 wherein the additional action is one of sanitizing the applicator by exposure to UV light, blowing a gush of air or subjecting the applicator to a saturated environment before the applicator is fully propelled out, vibration of applicator, movement of applicator in either a uni-directional motion or in multiple motions or in an irregular motion or heating or cooling of the applicator for application by the user.

9. The cosmetic container of claim 1 wherein the protrusion-retraction action of the applicator occurs in a single step.

10. The cosmetic container of claim 1 wherein the protrusion-retraction action of the applicator occurs in a series of steps.

11. The cosmetic container of claim 1 wherein the integrated applicator comprises a brush, a sponge, or a spatula.

12. The cosmetic container of claim 1 wherein the cosmetic product comprises a loose powder or pressed product comprising eye shadow, rouge, a blusher or a foundation.

* * * * *